US007298093B2

(12) United States Patent
Chang

(10) Patent No.: US 7,298,093 B2
(45) Date of Patent: Nov. 20, 2007

(54) METHOD AND DEVICE FOR DRIVING CCFL CIRCUIT

(75) Inventor: Ching-Chung Chang, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 189 days.

(21) Appl. No.: 11/245,517

(22) Filed: Oct. 7, 2005

(65) Prior Publication Data

US 2006/0261750 A1 Nov. 23, 2006

(30) Foreign Application Priority Data

May 19, 2005 (CN) ..... 2005 1 0073970

(51) Int. Cl.
*H01J 7/24* (2006.01)
*H05B 37/02* (2006.01)

(52) U.S. Cl. ..... 315/116; 315/117; 315/291

(58) Field of Classification Search ..... 315/112, 315/114, 115, 117, 291, 307, 309, 362, 113, 315/116

See application file for complete search history.

(56) References Cited

U.S. PATENT DOCUMENTS 5,336,976 A * 8/1994 Webb et al. ..... 315/134
5,907,742 A 5/1999 Johnson et al. ..... 399/51
6,198,234 B1 * 3/2001 Henry ..... 315/291
2006/0071601 A1 * 4/2006 Yamada et al. ..... 313/634

FOREIGN PATENT DOCUMENTS

JP 11-305196 11/1999
TW I226788 1/2005

OTHER PUBLICATIONS

Taiwan Patent Office Action mailed Mar. 7, 2006.

* cited by examiner

*Primary Examiner*—Thuy Vinh Tran
(74) *Attorney, Agent, or Firm*—Thomas, Kayden, Horstemeyer & Risley

(57) ABSTRACT

A driving device for a CCFL circuit comprising at least one CCFL is provided. The driving device comprising at least one heating device controlling the temperature of the at least one CCFL, a power supply outputting a first voltage, and a switching device having a first input terminal receiving the first voltage and a first and second output terminal; wherein the first output terminal is coupled to the CCFL circuit outputting a second voltage when the first voltage is higher than a first level, and the second output terminal is coupled to the at least one heating device outputting a third voltage when the first voltage is lower than the first level. The driving device further comprises a controller controlling the power supply to output the first voltage higher than the first level to lighting up the at least one CCFL, and lower than the first level to control the temperature of the at least one CCFL.

18 Claims, 3 Drawing Sheets

| | 2131 | 2132 |
|---|---|---|
| DC1≧V1 | ON | OFF |
| DC1 < V1 | OFF | ON |

| | 2131 | 2132 |
|---|---|---|
| DC1 ≧ V1 | ON | OFF |
| DC1 < V1 | OFF | ON |

| | 2131 | 2132 |
|---|---|---|
| DC1 ≧ V2 | ON | ON |
| V1 ≦ DC1 < V2 | ON | OFF |
| V1 > DC1 | OFF | ON |

METHOD AND DEVICE FOR DRIVING CCFL CIRCUIT

BACKGROUND

The invention relates to a cold cathode fluorescent lamp (CCFL) circuit and, more particularly, to devices for rapidly lighting a CCFL.

CCFL is a widely used light source in electronic devices such as scanners, LCD panels, notebook PCs and LCD televisions. Illumination of a conventional CCFL, however, may take up to 3 minutes to achieve stability after power up. FIG. 1 is a block diagram of a conventional electronic device 10 comprising a CCFL circuit. Electronic device 10 comprises a power supply 11 and a CCFL circuit 12 comprising at least one CCFL 121. Power supply 11 provides a voltage DC1 to the CCFL circuit 12. CCFL circuit 12 generates a high voltage AC supply according to the voltage DC1 to light CCFL 121.

A method to drive a CCFL is provided by Johnson, et al. (U.S. Pat. No. 5,907,742, "Lamp control scheme for rapid warm-up of fluorescent lamp in office equipment"). The lamp is over-driven with high current for up to a predetermined time limit to accelerate mercury vaporization. The drive current is then reduced to a normal level. Between each use, the lower lamp current is 40% of the normal level to keep the lamp warm while extending the life of the product.

Using Johnson's Method, a certain amount of power is required when the CCFL is not working to maintain the temperature of the CCFL. The power consumed at the lower lamp current state is significant and additional logic circuits are required for controlling current in different states. Furthermore, if a longer length CCFL is utilized in electronic device 10, to raise the current when lighting the CCFLs, the CCFL circuit 12 receives higher voltage DC1 and generates higher voltage AC power. Consequently, transformers used in CCFL circuit 12 may not be capable of sustaining such a high voltage and may need to be upgraded, which leads to additional manufacturing cost.

A driving device for a CCFL circuit comprising at least one CCFL is provided. The driving device comprises: at least one heating device controlling the temperature of the CCFL; a power supply outputting a first voltage; a switching device having a first input terminal receiving the first voltage and a first and second output terminal outputting a second and third voltage respectively. The first output terminal is coupled to the CCFL circuit to output the second voltage when the first voltage is higher than a first level. The second output terminal is coupled to the heating device to output the third voltage when the first voltage is lower than the first level. The driving device further comprises a controller controlling the power supply to output the first voltage higher than the first level to light the CCFL, and lower than the first level to control the temperature of the CCFL.

DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION

The invention provides a heating device maintaining the temperature of an idle CCFL, and enabling rapid lighting thereof.

Figure 1:
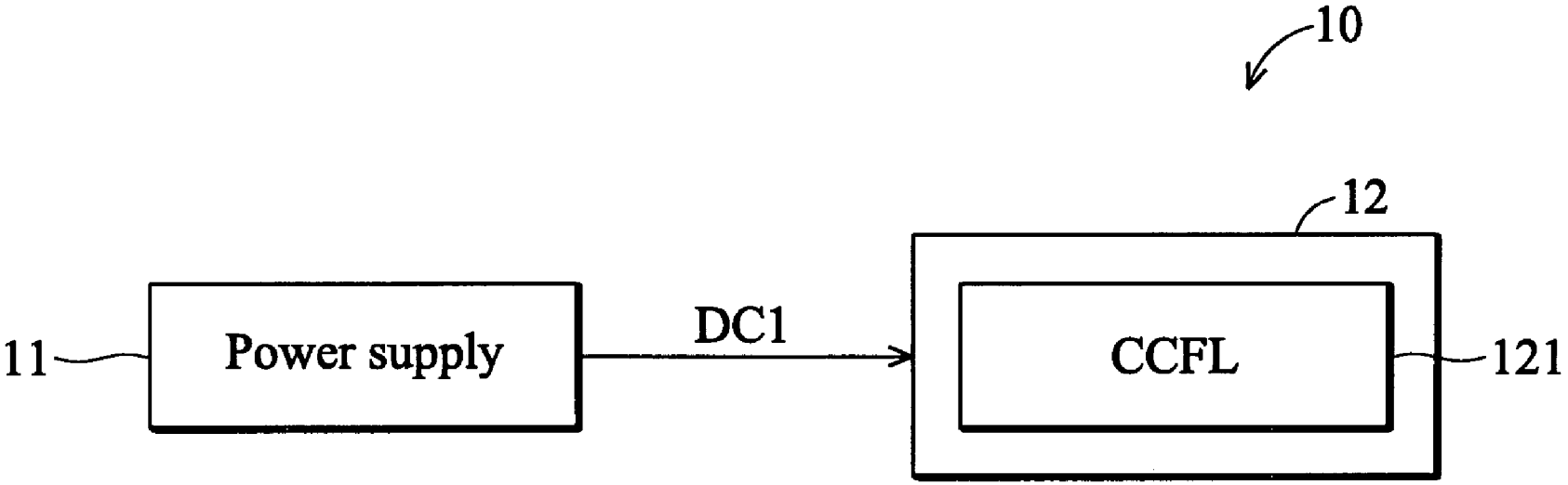
FIG. 1 (RELATED ART)
FIG. 1 is a block diagram of a conventional electronic device comprising a CCFL circuit.
Figure 2A:
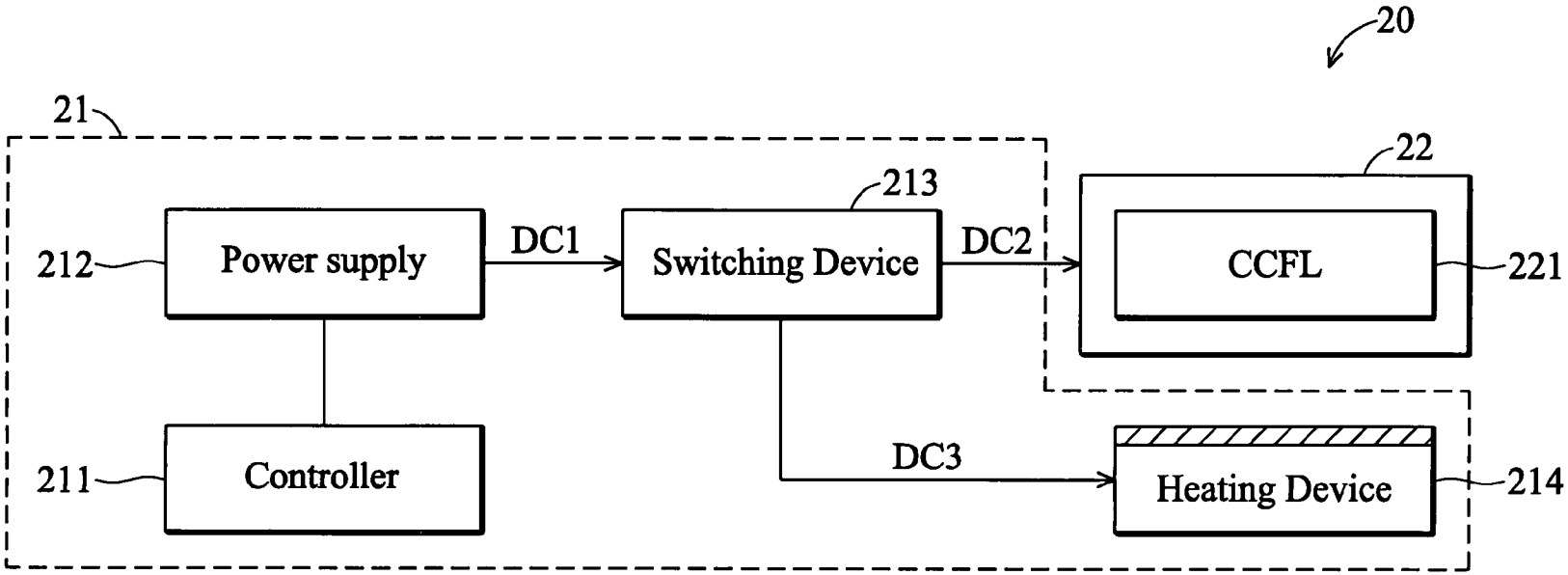
FIG. 2A is a block diagram of an electronic device according to an embodiment of the invention.

FIG. 2A is a block diagram of an electronic device 20 according to an embodiment of the invention. Electronic device 20 comprises CCFLs as a light source and may be a scanner, an LCD panel, a notebook PC or an LCD television, for example.

The electronic device 20 comprises a driving device 21 and a CCFL circuit 22 comprising at least one CCFL 221. Driving device 21 comprises a controller 211, a power supply 212, a switching device 213 and a heating device 214.

Power supply 212 outputs a first voltage DC1, controlled by the controller 211. Switching device 213 has a first input terminal receiving the first voltage DC1 and a first and second output terminal. The first output terminal is coupled to the CCFL circuit 22 outputting the second voltage DC2 when the first voltage DC1 is higher than a first level V1. The second output terminal is coupled to the heating device 214 outputting the third voltage DC3 when the first voltage DC1 is lower than the first level V1. In this embodiment, the controller 211 controls the power supply 212 to output the first DC voltage DC1 higher than the first level V1 to light the CCFL 221. The voltage switching device 213 provides the second DC voltage DC2 to the CCFL circuit 22 for lighting the CCFL 221. Simultaneously, the third DC voltage DC3 is cut off. Thus, the heating device stops working.

Additionally, controller 211 controls the power supply 212 to output the first DC voltage DC1 lower than the first level V1 to control the temperature of the CCFL 211 when the CCFL 211 is idle. The voltage switching device 213 cuts off the second DC voltage DC2 and the power supply 212 snuffs out the CCFL 221. Simultaneously, the third DC voltage DC3 is output. The heating device 214 heats the CCFL 221 such that the CCFL 221 is rapidly lit when required next time.

Figure 2B:
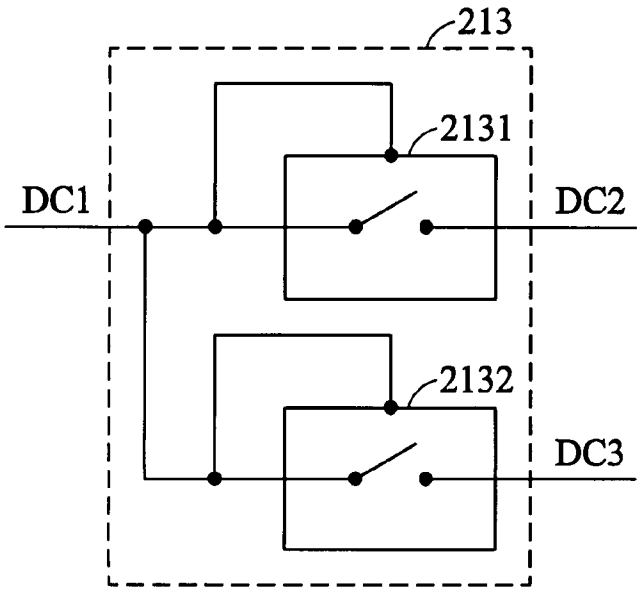
FIGS. 2B and 2C are block diagrams of different embodiments of the switching device of FIG. 2A.

FIG. 2B is a block diagram of an embodiment of the switching device 23 of FIG. 2A. Switching device comprise switching units 2131 and 2132. Switching unit 2131 is ON when the first voltage is higher than the first level V1, and is OFF when the first voltage is lower than the first level V1. Switching unit 2132 is OFF when the first voltage is higher than the first level V1, and is ON when the first voltage is lower than the first level V1.

In this embodiment, a simply two-state DC voltage control method is utilized to control a boot mode and a sleep mode of the CCFL. In the sleep mode, the CCFL is idle and stops receiving current. In the sleep mode, the temperature of the CCFL is maintained such that the power consumption caused by the CCFL is solved.

A second level V2 higher than the first level V1 is provided for an extra function of this embodiment. The function of the first output terminal of switching device 23 remains the same. The second output terminal of switching device 23 outputs the third voltage DC3 when the first voltage DC1 is lower than the first level V1 or higher than the second level V2. In this embodiment, when the first voltage is higher than the second level V2, the CCFL is lit and the heating device 214 heats the CCFL 221. The temperature of the CCFL 221 may be increased rapidly and illumination of the CCFL 221 may rapidly reach the working illumination.

Figure 2C:
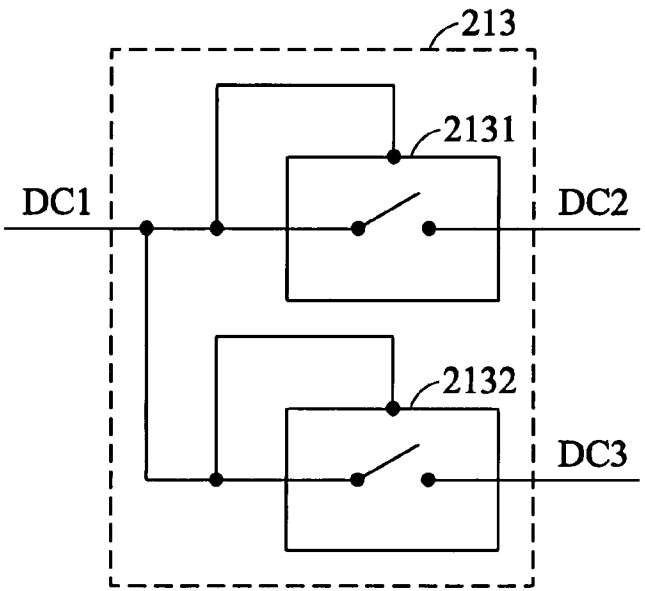

FIG. 2C is a block diagram of another embodiment of the switching device 23 of FIG. 2A. Switching device 23 comprises switching units 2131 and 2132. Switching unit 2131 is ON when the first voltage DC1 is higher than the first level V1, and is OFF when the first voltage is lower than the first level V1. Switching unit 2132 is OFF when the first voltage DC1 is between the first level V1 and the second level V2, and ON when the first voltage is lower than the first level V1 or higher than the second level V2.

In this embodiment, controller 211 controls the power supply 21 to light the CCFL 221 when the first DC voltage DC1 is higher than the first level V1 and lower than the second level V2. The voltage switching device 213 provides the second DC voltage DC2 to the CCFL circuit 22 for lighting the CCFL 221. Simultaneously, the third DC voltage DC3 is cut off such that the heating device stops working.

Additionally, controller 221 controls the power supply 21 to output the first DC voltage DC1 lower than the first level V1 when the CCFL stops working. The voltage switching device 213 cuts off the second DC voltage DC2 such that the CCFL circuit 22 snuffs out the CCFL 221. Simultaneously, the third DC voltage DC3 is output such that the heating device 214 heats the CCFL 221. Thus, the CCFL 221 is lit rapidly when required next time.

Controller 211 further controls the power supply 21 to output the first DC voltage DC1 higher than the second level V2 to rapidly light the CCFL 221. The voltage switching device 213 provides the second DC voltage DC2 to the CCFL circuit 22 for lighting the CCFL 221. Simultaneously, the third DC voltage DC3 is output such that the heating device 214 heats the CCFL 221. Thus, the temperature of the CCFL 221 rapidly arrives an operation temperature.

In this embodiment, a simply three-state DC voltage control method is utilized to control a rapid light mode, a boot mode, and a sleep mode of the CCFL. In the rapid light mode, since the CCFL is heated, the CCFL is not required to receiving a higher current and the CCFL is rapidly lit. In the sleep mode, the CCFL is idle and the CCFL is not required to receive current. In the sleep mode. the temperature of the CCFL is maintained such that the power consumption caused by the CCFL is solved.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A driving device for a cold cathode fluorescent lamp (CCFL) circuit comprising at least one CCFL, comprising:

at least one heating device heating the at least one CCFL;

a power supply outputting a first voltage;

a switching device having a first input terminal receiving the first voltage and a first and second output terminal outputting a second and third voltage respectively; wherein the first output terminal is coupled to the CCFL circuit and outputs the second voltage when the first voltage is higher than a first level, and the second output terminal is coupled to the at least one heating device and outputs the third voltage when the first voltage is lower than the first level; and a controller controlling the power supply to output the first voltage higher than the first level to light the at least one CCFL, and lower than the first level to heat the at least one CCFL.

2. The driving device as claimed in claim 1, wherein the switching device comprises a first switching unit coupled between the input terminal and the first output terminal, and a second switching unit coupled between the input terminal and the second output terminal; wherein the first and second switching unit is ON and OFF respectively when the first voltage is higher than the first level, and OFF and ON respectively when the first voltage is lower than the first level.

3. The driving device as claimed in claim 1, wherein:

the switching device further outputs both the second and third voltage when the first voltage is higher than a second level; wherein the second level is higher than the first level; and the controller further controls the power supply to output the first voltage higher than the second level to rapidly light the at least one CCFL.

4. The driving device as claimed in claim 1, wherein the switching device comprises a first switching unit coupled between the input terminal and the first output terminal, and a second switching unit coupled between the input terminal and the second output terminal; wherein the first switching unit is ON when the first voltage is higher than the first level, and is OFF when the first voltage is lower than the first level; and the second switching unit is ON when the first voltage is higher than the second level or lower than the first level, and is OFF when the first voltage is between the first and second level.

5. The driving device as claimed in claim 1, wherein when the at least one CCFL is to be in a sleep mode, the controller controls the power supply to output the first voltage lower than the first level to heat the at least one CCFL.

6. The driving device as claimed in claim 5, wherein when the at least one CCFL is to be in a boot mode, the controller controls the power supply to output the first voltage higher than the first level to light the at least one CCFL.

7. The driving device as claimed in claim 5, wherein when the at least one CCFL is to be in a rapid mode, the controller controls the power supply to output the first voltage higher than a second level to heat and light the at least one CCFL, and wherein the second level is higher than the first level.

8. The driving device as claimed in claim 7, wherein when the at least one CCFL is to be in the rapid mode, the switching device outputs both the second and third voltage when the first voltage is higher than the second level.

9. An electronic device comprising:

a CCFL circuit comprising at least one CCFL;

at least one heating device heating the at least one CCFL;

a power supply outputting a first voltage;

a switching device having a first input terminal receiving the first voltage and a first and second output terminal outputting a second and third voltage respectively; wherein the first output terminal is coupled to the CCFL circuit and outputting the second voltage when the first voltage is higher than a first level, and the second output terminal is coupled to the at least one heating device and outputting the third voltage when the first voltage is lower than the first level; and a controller controlling the power supply to output the first voltage higher than the first level to lighting up the at least one CCFL, and lower than the first level to heat the at least one CCFL.

10. The electronic device as claimed in claim 9, wherein the switching device comprises a first switching unit coupled between the input terminal and the first output terminal, and a second switching unit coupled between the input terminal and the second output terminal; wherein the first and second switching unit is ON and OFF respectively when the first voltage is higher than the first level, and OFF and ON respectively when the first voltage is lower than the first level.

11. The electronic device as claimed in claim 9, wherein:

the switching device further outputs both the second and third voltage when the first voltage is higher than a second level; wherein the second level is higher than the first level; and the controller further controls the power supply to output the first voltage higher than the second level to rapidly light the at least one CCFL.

12. The electronic device as claimed in claim 11, wherein the switching device comprises a first switching unit coupled between the input terminal and the first output terminal, and a second switching unit coupled between the input terminal and the second output terminal; wherein the first switching unit is ON when the first voltage is higher than the first level, and is OFF when the first voltage is lower than the first level; and the second switching unit is ON when the first voltage is higher than the second level or lower than the first level, and is OFF when the first voltage is between the first and second level.

13. The electronic device as claimed in claim 9, wherein when the at least one CCFL is to be in a sleep mode, the controller controls the power supply to output the first voltage lower than the first level to heat the at least one CCFL.

14. The electronic device as claimed in claim 13, wherein when the at least one CCFL is to be in a boot mode, the controller controls the power supply to output the first voltage higher than the first level to light the at least one CCFL.

15. The electronic device as claimed in claim 13, wherein when the at least one CCFL is to be in a rapid mode, the controller controls the power supply to output the first voltage higher than a second level to heat and light the at least one CCFL, and wherein the second level is higher than the first level.

16. The electronic device as claimed in claim 15, wherein when the at least one CCFL is to be in the rapid mode, the switching device outputs both the second and third voltage when the first voltage is higher than the second level.

17. A method for driving a CCFL circuit comprising at least one CCFL, comprising:

providing a heating device heating the at least one CCFL;

utilizing a power supply to provide a first voltage:

providing a second voltage to the CCFL circuit when the first voltage is higher than a first level; and providing a third voltage to the heating device when the first voltage is lower than a first level.

18. The method as claimed in claim 17, further comprising:

providing both the second and third voltage when the first voltage is higher than a second level, to light up the at least one CCFL and heating the at least one CCFL at the same time; wherein the second level is higher than the first level.

* * * * *